US010234192B2

(12) United States Patent
Tang

(10) Patent No.: US 10,234,192 B2
(45) Date of Patent: Mar. 19, 2019

(54) MULTIFUNCTIONAL PORTABLE SOUND EQUIPMENT

(71) Applicant: NINGBO RIXING ELECTRONICS CO., LTD., Ningbo (CN)

(72) Inventor: Yong Tang, Ningbo (CN)

(73) Assignee: NINGBO RIXING ELECTRONICS CO., LTD., Ningbo (CN)

( * ) Notice: Subject to any disclaimer, the term of this patent is extended or adjusted under 35 U.S.C. 154(b) by 0 days.

(21) Appl. No.: 15/650,908

(22) Filed: Jul. 16, 2017

(65) Prior Publication Data

US 2017/0314845 A1 Nov. 2, 2017

Related U.S. Application Data

(63) Continuation of application No. PCT/CN2015/093217, filed on Oct. 29, 2015.

(30) Foreign Application Priority Data

Jan. 16, 2015 (CN) ..... 2015 1 0022130

(51) Int. Cl.

| | |
|---|---|
| ***H04R 5/02*** | (2006.01) |
| ***F25D 23/12*** | (2006.01) |
| ***F25D 3/08*** | (2006.01) |
| ***H04R 1/02*** | (2006.01) |
| ***H04R 1/28*** | (2006.01) |
| *F25D 3/06* | (2006.01) |

(52) U.S. Cl.

CPC ..... *F25D 23/12* (2013.01); *F25D 3/08* (2013.01); *H04R 1/026* (2013.01); *H04R 1/028* (2013.01); *H04R 1/2807* (2013.01); *H04R 5/02* (2013.01); *F25D 3/06* (2013.01); *H04R 2201/028* (2013.01); *H04R 2420/07* (2013.01)

(58) Field of Classification Search

CPC ... F25D 23/12; F25D 3/08; F25D 3/06; H04R 5/02; H04R 1/2807; H04R 1/026; H04R 1/028; H04R 2201/028; H04R 2420/07

See application file for complete search history.

(56) References Cited

U.S. PATENT DOCUMENTS

| | | | | |
|---|---|---|---|---|
| 5,235,822 A * | 8/1993 | Leonovich, Jr. | ..... | A45C 15/00 206/542 |
| 6,070,718 A | 6/2000 | Drabwell | | |
| 6,328,179 B1 * | 12/2001 | Conrado | ..... | F25D 3/06 220/592.2 |
| 7,677,406 B2 * | 3/2010 | Maxson | ..... | B65D 81/3823 220/592.2 |
| 9,150,235 B2 * | 10/2015 | Galante | ..... | F25D 3/08 |

FOREIGN PATENT DOCUMENTS

| | | |
|---|---|---|
| CN | 203986637 U | 12/2014 |
| CN | 104581455 A | 4/2015 |
| CN | 204291293 U | 4/2015 |
| KR | 20110005972 A | 1/2011 |
| WO | 2013073967 A2 | 5/2013 |

* cited by examiner

*Primary Examiner* — Brian Ensey
(74) *Attorney, Agent, or Firm* — W&K IP(Wayne & King)

(57) ABSTRACT

A portable sound equipment comprises an equipment body, and the equipment body is mainly composed of a box body and a box cover capable of being folded and unfolded. A heat preservation cavity is arranged in the box body; and a sealing cover of the box cover is connected to an opening of the heat preservation cavity. The portable sound equipment has multiple functions.

8 Claims, 20 Drawing Sheets

MULTIFUNCTIONAL PORTABLE SOUND EQUIPMENT

CROSS-REFERENCE TO RELATED APPLICATIONS

This application is a continuation of International Patent Application No. PCT/CN2015/093217 with a filing date of Oct. 29, 2015, designating the United States, now pending, and further claims priority to Chinese Patent Application No. 201510022130.X with a filing date of Jan. 16, 2015. The content of the aforementioned applications, including any intervening amendments thereto, are incorporated herein by reference.

TECHNICAL FIELD

The present invention relates to a portable sound equipment, and particularly relates to a multifunctional portable sound equipment.

BACKGROUND OF THE PRESENT INVENTION

Portable sound equipment, also known as mobile sound equipment, is a music player that integrates a power amplifier, a player and a loudspeaker.

With the increase of modern living rhythm of people, more and more urban people choose to do outdoor exercise, such as field camping, picnic, exploration, etc. together with families or friends at weekends, so as to adjust self mental pressure. At the time of doing the above outdoor exercise, people often take the above portable sound equipment, so that the whole outdoor exercise is always accompanied by sweet music.

However, existing portable sound equipment has a technical defect of too single functionality. Therefore, further improvement is necessary.

SUMMARY OF PRESENT INVENTION

The purpose of the present invention is to solve the above technical defect so as to provide multifunctional portable sound equipment having a heat preservation storage function and capable of being used as a dining table.

To realize the above purpose, the multifunctional portable sound equipment designed in the present invention comprises an equipment body, wherein the equipment body is mainly composed of a box body and a box cover capable of being folded and unfolded; a heat preservation cavity is arranged in the box body; and a sealing cover of the box cover is connected to an opening of the heat preservation cavity.

In the box body of multifunctional portable sound equipment provided above, the heat preservation cavity is arranged to be used for cold storage or heat storage of food and beverages; and meanwhile, since the box cover on the box body can be randomly unfolded and folded, when the above box cover is unfolded, it can be used as a dining table, to realize convenience and quickness.

The surrounding wall of the heat preservation cavity is made of efficient heat preservation material, wherein the efficient heat preservation material includes two categories: inorganic material and organic material, which including polyurethane foam, polyphenyl board, phenolic foam, aerogel blanket, glass wool, rock wool, expanded perlite, and micro-nano heat insulating plate, etc. which can be correspondingly selected by people according to specific use conditions.

As a preferred technical solution, the box cover capable of being folded and unfolded has a specific structure as follows: the box cover is mainly composed of a box cover substrate and at least one box cover panel, a sealing cover of the box cover substrate is connected to an opening of the heat preservation cavity, the box cover panel is located above the box cover substrate, circumferential parts of the box cover panel and the box cover substrate are in a hinged structure, and relative to the box cover substrate, the box cover panel can turn around a hinging shaft at 180°.

The box cover capable of being folded and unfolded in the above preferred technical solution has a simple specific structure and is convenient and quick in use. As a further preferred solution, the number of the box cover panels is preferably two, and the two box cover panels are symmetrically located above the box cover substrate.

When articles are taken from the heat preservation cavity, to avoid excessive air ventilation between the heat preservation cavity and the outside and ensure heat preservation performance of the heat preservation cavity, an article taking opening is arranged on the box cover substrate, and a covering cap capable of sealing and covering the article taking opening is hinged on an opening edge of the article taking opening.

Through the box cover substrate designed in the above structure, people not only can conveniently take out articles from the heat preservation cavity through the article taking opening on the box cover substrate, but also can effectively avoid excessive air ventilation of the heat preservation cavity with the outside, thereby prolonging an effective heat preservation period of the heat preservation cavity.

To store different food materials according to categories, a middle separating plate for separating the heat preservation cavity into at least two independent chambers is arranged in the heat preservation cavity. As a further preferred technical solution, an installation structure of the middle separating plate is designed into a drawing-inserting type structure, i.e., a guidance slot is formed in an inner wall of the heat preservation cavity, and then the middle separating plate is inserted along the guidance slot when the middle separating plate is required to separate the heat preservation cavity.

At the time of cold storage of ice blocks, food materials and beverages in a heat preservation box, to remove and clean liquid water generated due to temperature rise after long-term cold storage in time, a drainage passage communicated with the heat preservation cavity is also arranged on the box body; the drainage passage is located below a back surface of the box body; and a sealing cover is additionally arranged on a passage opening of the drainage passage.

To facilitate stable and convenient placement of some portable digital products such as a tablet personal computer or a mobile phone, etc. on the box cover of the portable sound equipment, and to adjust placing angles of the placed portable digital products, a turning supporting seat is additionally arranged on the box cover panel; the turning supporting seat comprises a seat plate used for placing the tablet personal computer or the mobile phone, and a supporting plate capable of being accommodated in the seat plate; one side end part of the supporting plate is hinged on the seat plate; at least one stopping groove is arranged in the box cover panel; the stopping grooves are arranged in a direction of a turning track of the turning supporting seat according to a distance away from the turning supporting seat; and when the supporting plate is in a used state, the other side end part is embedded into any one of the stopping grooves.

To facilitate convenient and safe storage of the mobile phone in the box body of the portable sound equipment, a power amplification operating window is arranged on a front surface of the box body; at least one mobile phone accommodating opening is arranged on an inner surface of the power amplifier operating window; and a turning window covering cap capable of sealing the power amplifier operating window is hinged on an outer window edge of the power amplifier operating window.

Besides a series of functions of a general sound power amplifier, the power amplifier operating window preferably has a wireless generator, a Bluetooth generator and a battery USB charging interface, so that the portable sound equipment provided in the present invention can provide wireless and Bluetooth signals for the portable digital products, and can also perform emergency charging for the portable digital products during outdoor use.

For the convenience of moving the portable sound equipment during outdoor use, a pull rod component is fixed on the back surface of the box body; the pull rod component is in a centering structure; and at least one pair of rollers is arranged on a bottom surface of the box body. The above pull rod component is preferably selected from a telescopic pull rod component.

Finally, a cutlery is detachably fixed on an inner surface of the box cover substrate in the portable sound equipment structure. A wine opener, a microphone and a flashlight are detachably fixed on a back surface of the box body; and at least one limiting groove used for placing a cup or bottle is arranged in the box cover panel. At least one pair of hook holes is arranged on the bottom surface of the box body; surfaces on both sides are provided with notches facilitating hand grasp of a user when the user needs to move the portable sound equipment; the notches on the surfaces on both sides mutually correspond to each other; a grid mesh is arranged on an edge of each notch; a gap is arranged above the grid mesh. Of course, in an actual production process of a product, the above auxiliary functions can be appropriately added or reduced according to specific production requirements.

The multifunctional portable sound equipment obtained in the present invention has the functions of three categories of the sound system, the heat preservation box and the dining table as well as some other auxiliary functions, and well integrates the above functions into the portable sound equipment. At the time of going out to do the outdoor sports, people only need to bring the multifunctional portable sound equipment provided in the present invention, so as to enjoy high-quality outdoor life easily and conveniently.

Figure 1:
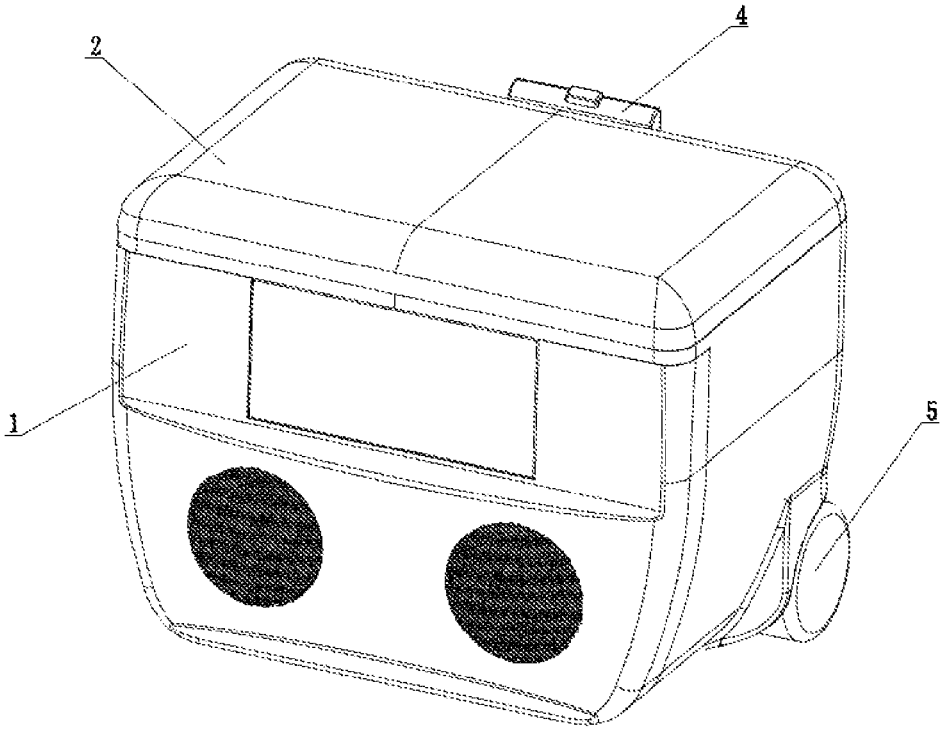
FIG. 1 is a structural schematic diagram 1 of multifunctional portable sound equipment provided in embodiment 1.

In the figures: box body 1; box cover 2; heat preservation cavity 3; pull rod component 4; roller 5; box cover substrate 6; box cover panel 7; article taking opening 8; covering cap 9; guidance slot 10; middle separating plate 11; drainage passage 12; sealing cover 13; support plate 14; stopping groove 15; power amplification operating window 16; mobile phone accommodating opening 17; cutlery 18; wine opener 19; microphone 20; flashlight 21; limiting groove 22; hook hole 23; notch 24; grid mesh 25; gap 26; USB charging interface 27; box cover main plate 28; box cover auxiliary plate 29; connecting column 30; clearance 31; window cover 32; seat plate 33; first scale 34; and second scale 35.

DETAILED DESCRIPTION OF PREFERRED EMBODIMENTS

The present invention is further described below in combination with drawings and embodiments.

Embodiment 1

Figure 2:
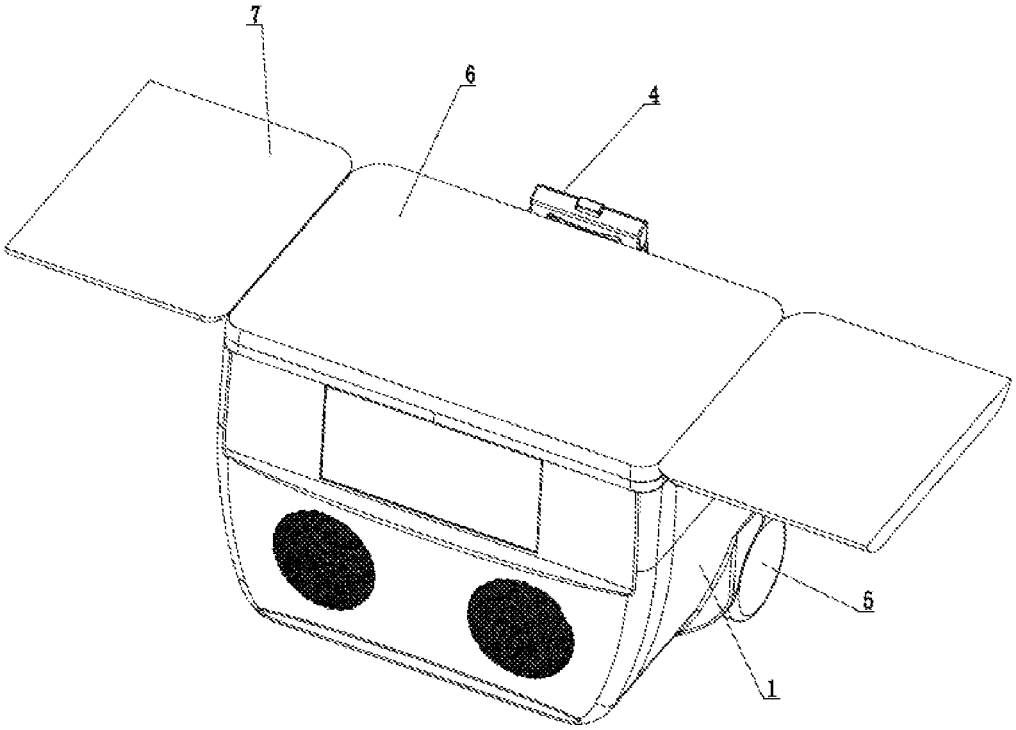
FIG. 2 is a structural schematic diagram 2 of multifunctional portable sound equipment provided in embodiment 1.
Figure 3:
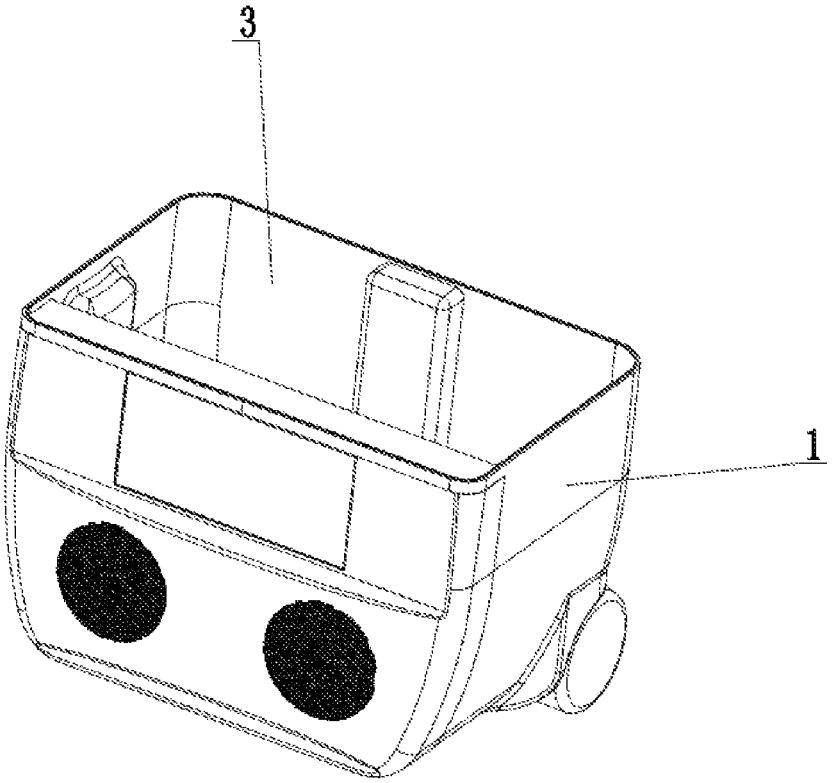
FIG. 3 is a structural schematic diagram of a box body in multifunctional portable sound equipment provided in embodiment 1.

As shown in FIGS. 1-3, the multifunctional portable sound equipment provided in the present embodiment comprises an equipment body, wherein the equipment body is mainly composed of a box body 1 and a box cover 2 capable of being folded and unfolded; a heat preservation cavity 3 is arranged in the box body 1; and a sealing cover of the box cover is connected to an opening of the heat preservation cavity 3. A pull rod component 4 is fixed on the back surface of the box body 1; the pull rod component 4 is in a centering structure; and at least one pair of rollers 5 is arranged on a bottom surface of the box body 1.

The box cover 2 capable of being folded and unfolded has a specific structure as follows: the box cover 2 is mainly composed of a box cover substrate 6 and at least one box cover panel 7, wherein the box cover substrate 6 is hinged to the opening of the heat preservation cavity 3, and can be turned and opened relative to the opening edge of the heat preservation cavity 3; however, when the box cover substrate 6 with the above structure is covered on the opening edge of the heat preservation cavity 3, the above heat preservation cavity 3 can be completely sealed. The two box cover panels 7 are located above the box cover substrate 6. The two box cover panels 7 are in a mutually symmetrical structure. Respective peripheral parts are hinged with the box cover substrate 6, and relative to the box cover substrate 6, the box cover panels 7 can turn around respective hinging shafts at 180°. After the above two box cover panels 7 are completely unfolded, the two box cover panels 7 and the box cover substrate 6 form a smooth dining table surface.

In the multifunctional portable sound equipment provided above, the heat preservation cavity 3 is formed in the box body 1; the heat preservation cavity 3 can be used for cold storage or heat storage of food and beverages; and meanwhile, since the box cover 2 on the box body 1 can be randomly unfolded and folded, after the above box cover 2 is unfolded, the box cover 2 can be used as a dining table, to realize convenience and quickness.

Embodiment 2

Figure 4:
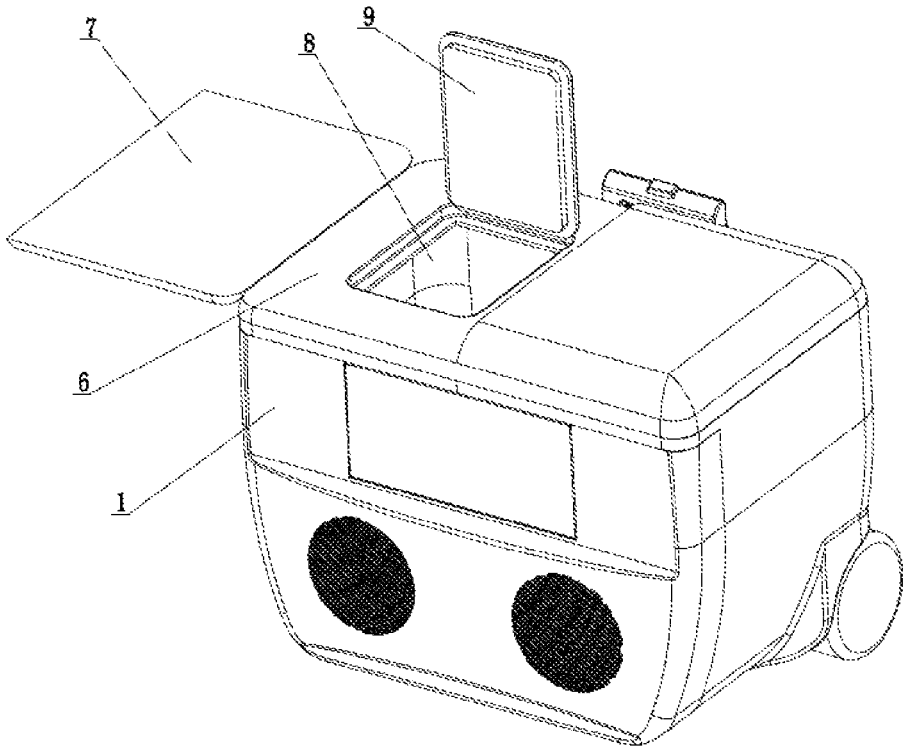
FIG. 4 is a structural schematic diagram 1 of multifunctional portable sound equipment provided in embodiment 2.
Figure 5:
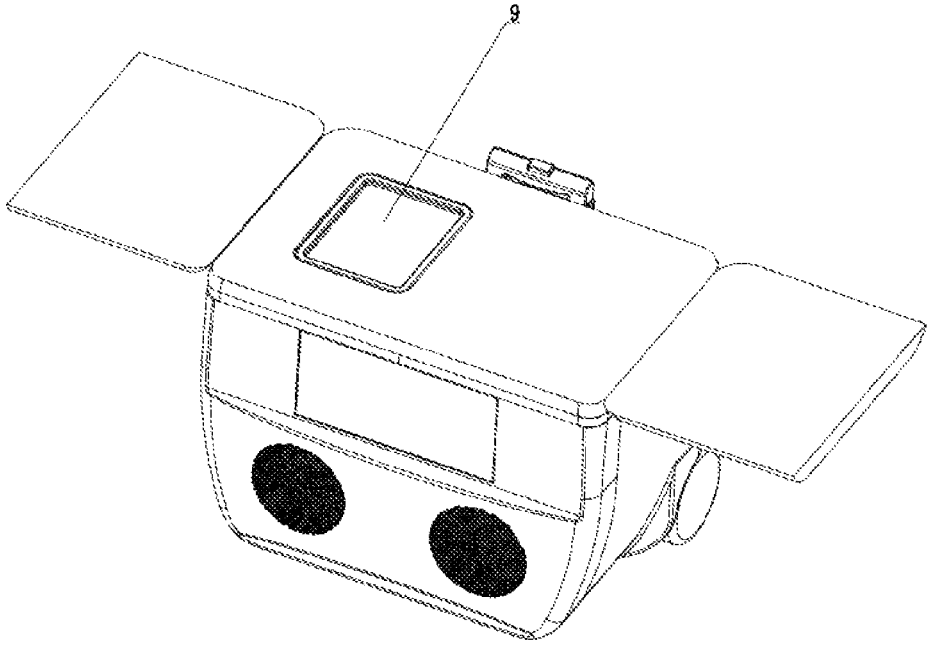
FIG. 5 is a structural schematic diagram 2 of multifunctional portable sound equipment provided in embodiment 2.

The multifunctional portable sound equipment provided in the present embodiment has a general structure consistent with that of the embodiment 1. However, when articles are taken from the heat preservation cavity 3, to avoid excessive air ventilation of the heat preservation cavity 3 with the outside and to ensure heat preservation performance of the heat preservation cavity 3, as shown in FIG. 4 and FIG. 5, in the multifunctional portable sound equipment provided in the present embodiment, an article taking opening 8 is arranged on the box cover substrate 6, and a covering cap 9 capable of sealing and covering the article taking opening 8 is hinged on an opening edge of the article taking opening 8.

Embodiment 3

Figure 6:
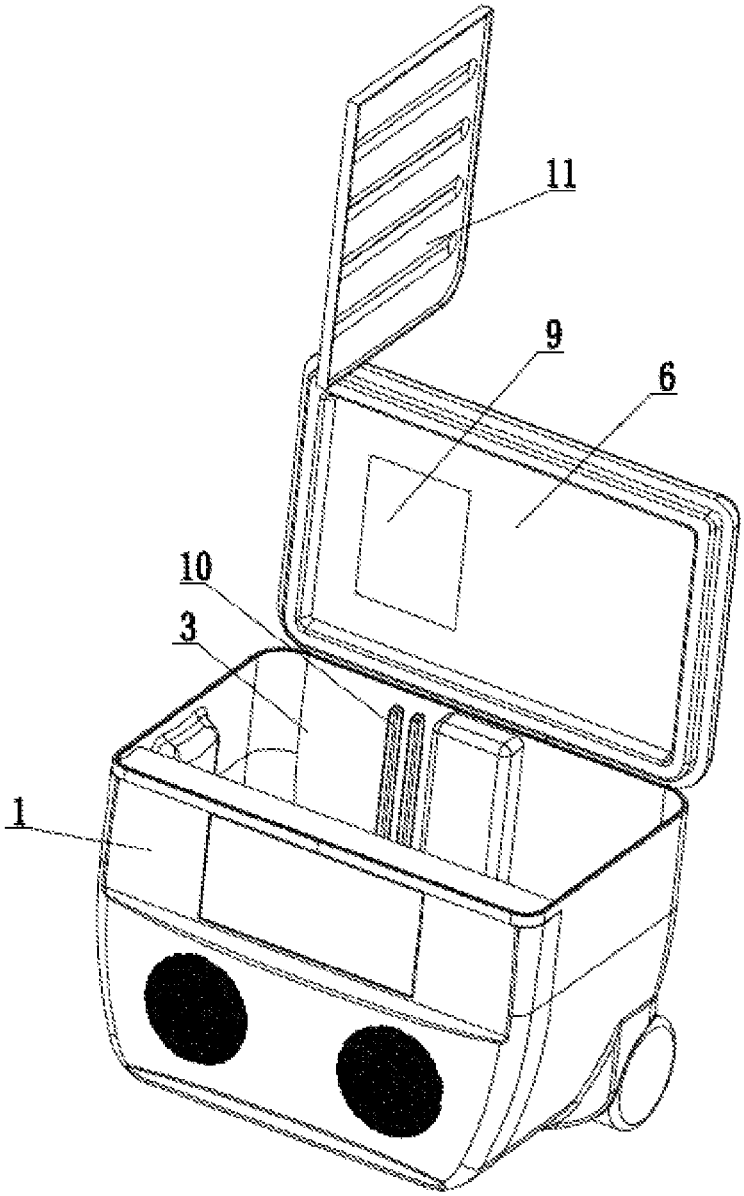
FIG. 6 is a structural schematic diagram of an equipment body and a middle separating plate after disassembly in multifunctional portable sound equipment provided in embodiment 3.
Figure 7:
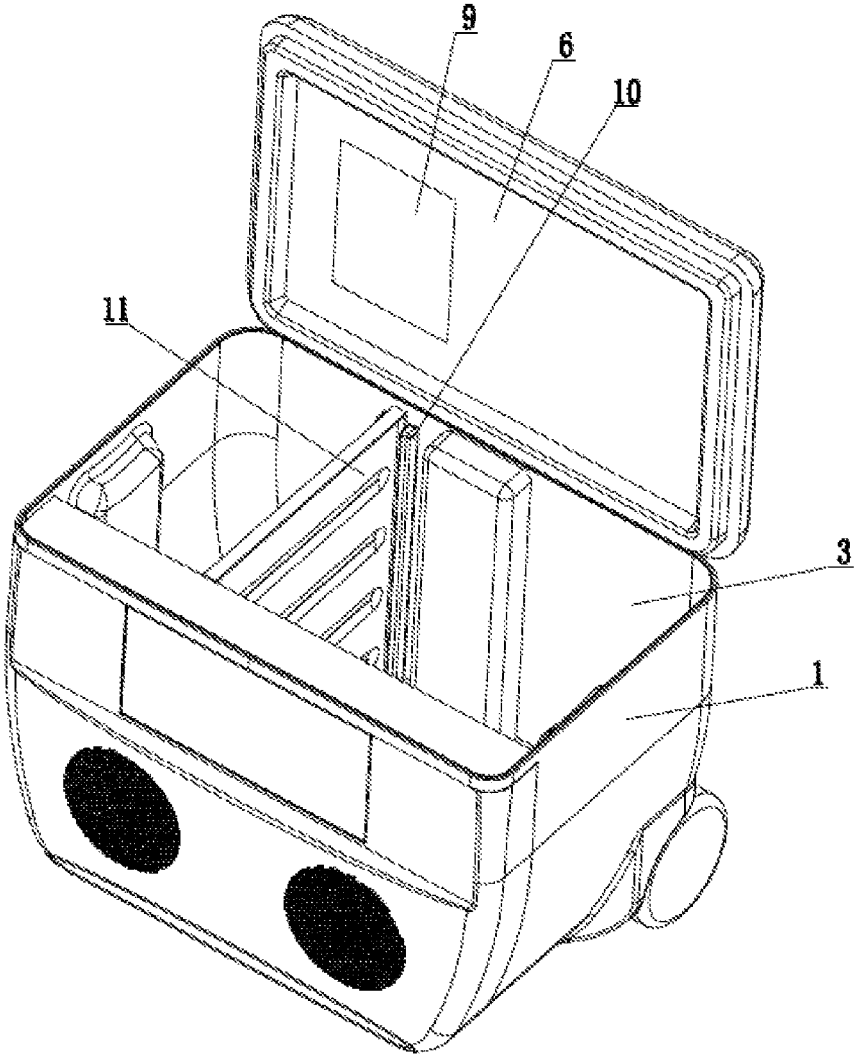
FIG. 7 is a structural schematic diagram of an equipment body and a middle separating plate after assembly in multifunctional portable sound equipment provided in embodiment 3.

The multifunctional portable sound equipment provided in the present embodiment has a general structure consistent with that of the embodiment 2. However, to store different food materials according to categories, as shown in FIG. 6 and FIG. 7, in the multifunctional portable sound equipment provided in the present embodiment, a guidance slot 10 is formed in an inner wall of the heat preservation cavity 3, and a middle separating plate 11 for separating the heat preservation cavity 3 into two independent chambers is inserted into the guidance slot 10.

Embodiment 4

Figure 8:
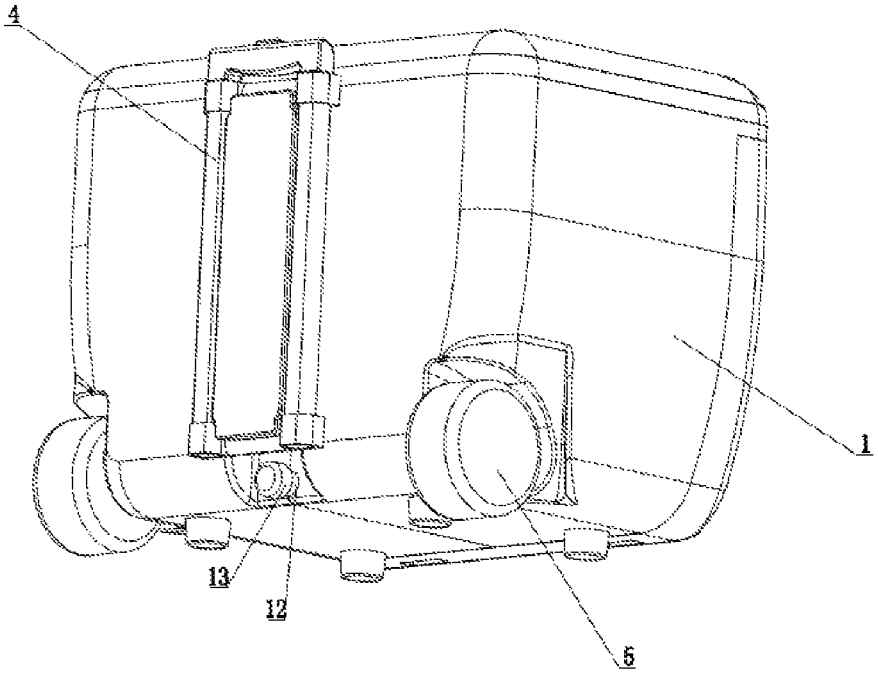
FIG. 8 is a structural schematic diagram of multifunctional portable sound equipment provided in embodiment 4.

The multifunctional portable sound equipment provided in the present embodiment has a general structure consistent with that of the embodiment 3. However, at the time of cold storage of ice blocks, food materials and beverages in the heat preservation box, to remove and clean liquid water generated due to temperature rise after long-term cold storage in time, as shown in FIG. 8, in the multifunctional portable sound equipment provided in the present embodiment, a drainage passage 12 communicated with the heat preservation cavity 3 is also arranged on the box body 1 in the structure; the drainage passage 12 is located below a back surface of the box body 1; and a sealing cover 13 is additionally arranged on a passage opening of the drainage passage 12.

Embodiment 5

Figure 9:
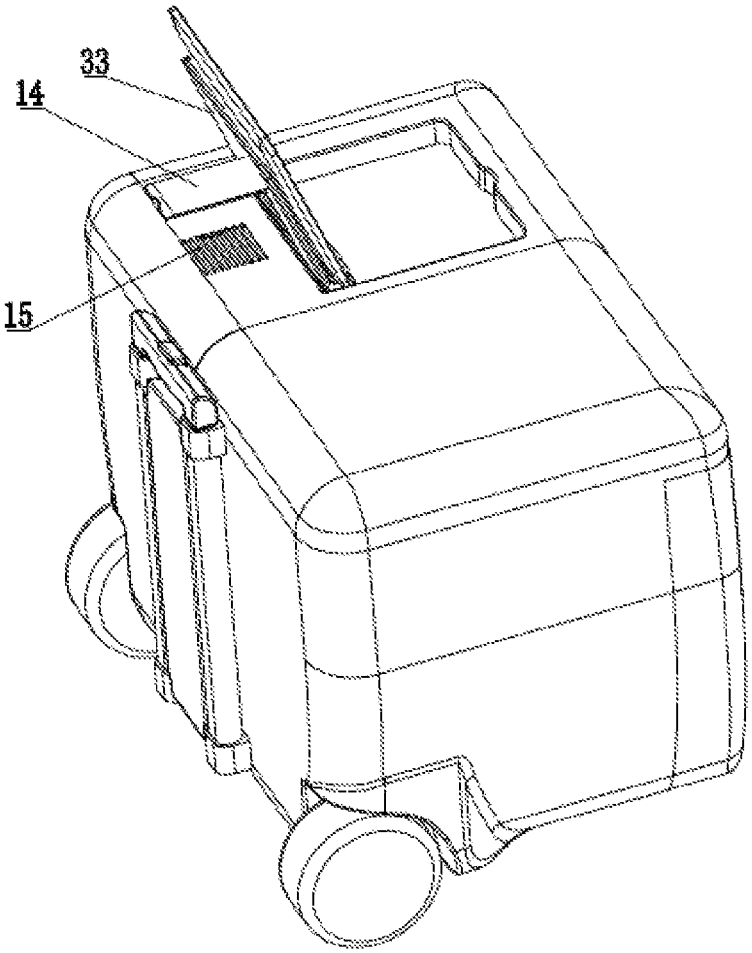
FIG. 9 is a structural schematic diagram 1 of multifunctional portable sound equipment provided in embodiment 5.
Figure 10:
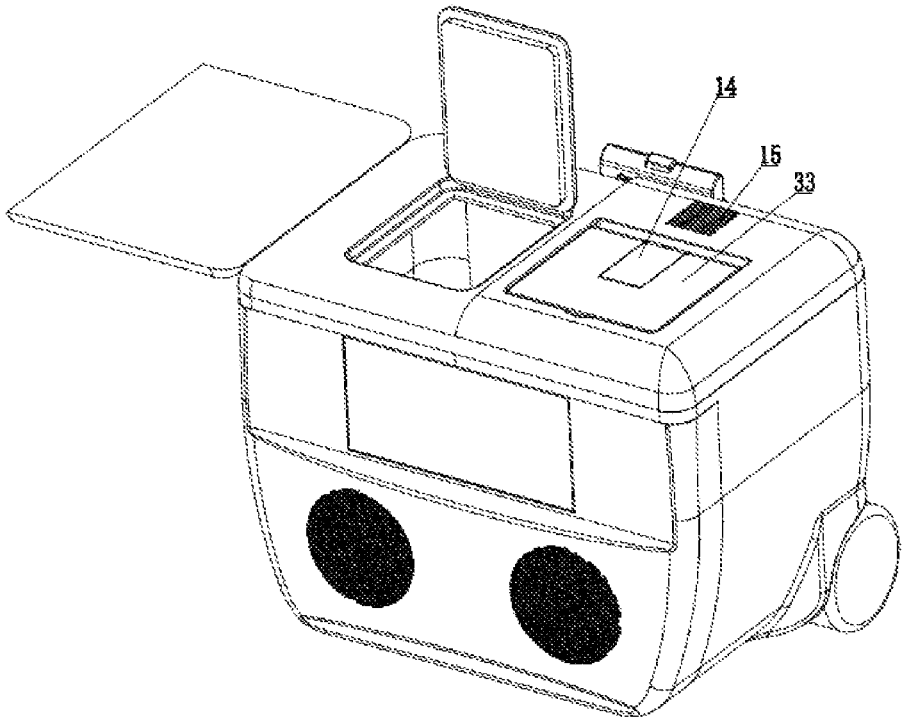
FIG. 10 is a structural schematic diagram 2 of multifunctional portable sound equipment provided in embodiment 5.

The multifunctional portable sound equipment provided in the present embodiment has a general structure consistent with that of the embodiment 4. However, to facilitate stable and convenient placement of some portable digital products such as a tablet personal computer or a mobile phone, etc. on the box cover 2 of the portable sound equipment, and to adjust placing angles of the placed portable digital products, as shown in FIG. 9 and FIG. 10, in the multifunctional portable sound equipment provided in the present embodiment, a turning supporting seat is additionally arranged on the box cover panel 7 in the structure; the turning supporting seat comprises a seat plate 33 used for placing the tablet personal computer or the mobile phone, and a supporting plate 14 capable of being accommodated in the seat plate 33; one side end part of the supporting plate 14 is hinged on the seat plate 33; a plurality of stopping grooves 15 are arranged in the box cover panel 7; the plurality of stopping grooves 15 are arranged in a direction of a turning track of the turning supporting seat according to a distance away from the turning supporting seat; and when the supporting plate 14 is in a used state, the other side end part is embedded into any one of the stopping grooves 15.

Embodiment 6

Figure 11:
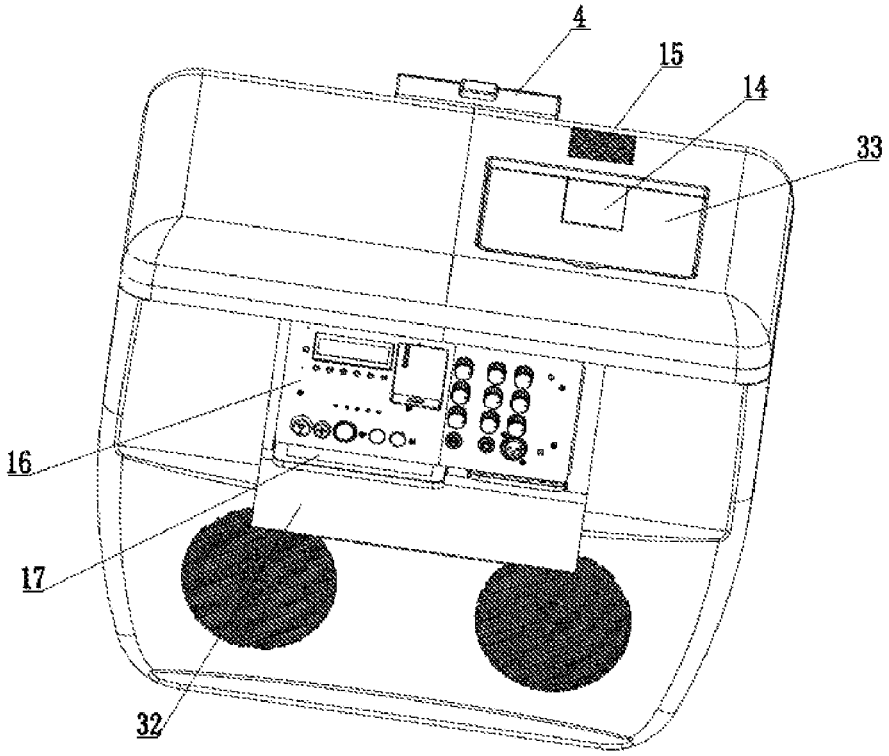
FIG. 11 is a structural schematic diagram of multifunctional portable sound equipment provided in embodiment 6.

The multifunctional portable sound equipment provided in the present embodiment has a general structure consistent with that of the embodiment 5. However, to facilitate convenient and safe storage of the mobile phone in the box body 1 of the portable sound equipment, as shown in FIG. 11, in the multifunctional portable sound equipment provided in the present embodiment, a power amplification operating window 16 is arranged on a front surface of the box body 1 in the structure; a mobile phone accommodating opening 17 is arranged on an inner surface of the power amplification operating window 16; and a turning window covering cap 32 capable of sealing the power amplification operating window 16 is hinged on an outer window edge of the power amplification operating window 16.

Embodiment 7

Figure 12:
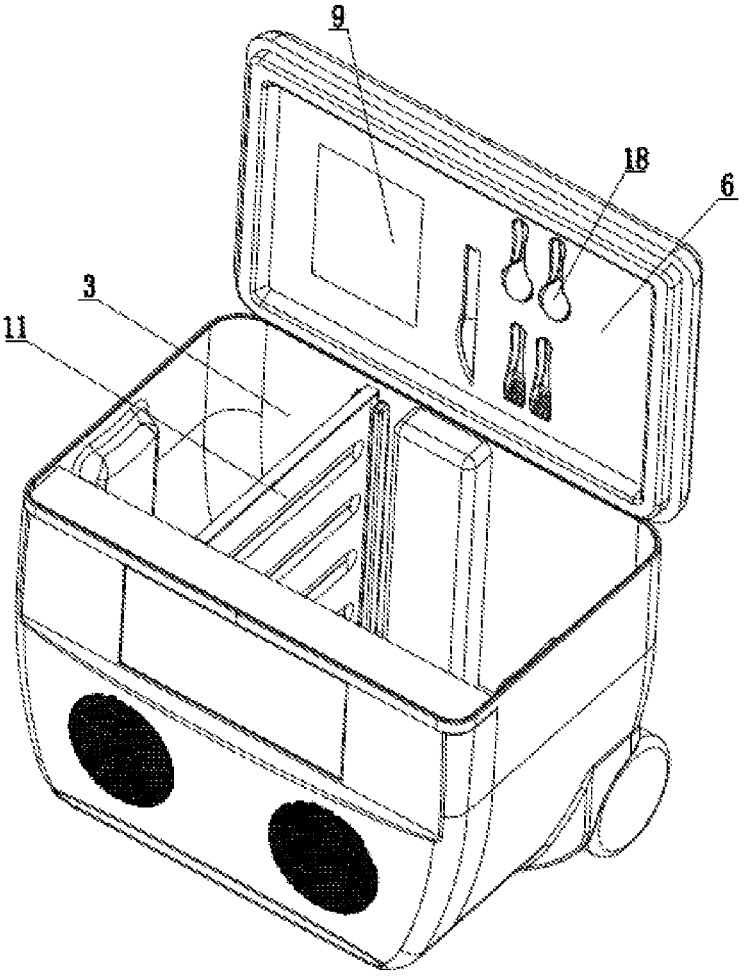
FIG. 12 is a structural schematic diagram of multifunctional portable sound equipment provided in embodiment 7.

The multifunctional portable sound equipment provided in the present embodiment has a general structure consistent with that of the embodiment 6, as shown in FIG. 12. However, in the multifunctional portable sound equipment provided in the present embodiment, a cutlery 18 is detachably fixed on an inner surface of the box cover substrate 6 in the portable sound equipment structure.

Embodiment 8

Figure 13:
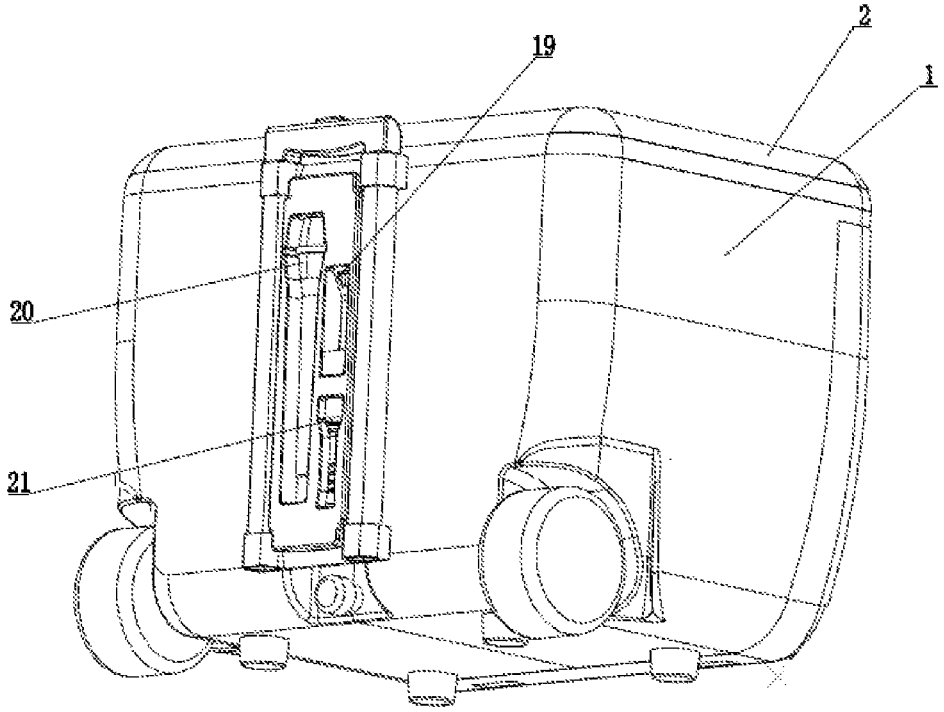
FIG. 13 is a structural schematic diagram of multifunctional portable sound equipment provided in embodiment 8.

The multifunctional portable sound equipment provided in the present embodiment has a general structure consistent with that of the embodiment 7, as shown in FIG. 13. However, in the multifunctional portable sound equipment provided in the present embodiment, a wine opener 19, a microphone 20 and a flashlight 21 are detachably fixed on a back surface of the box body 1 in the structure.

Embodiment 9

Figure 14:
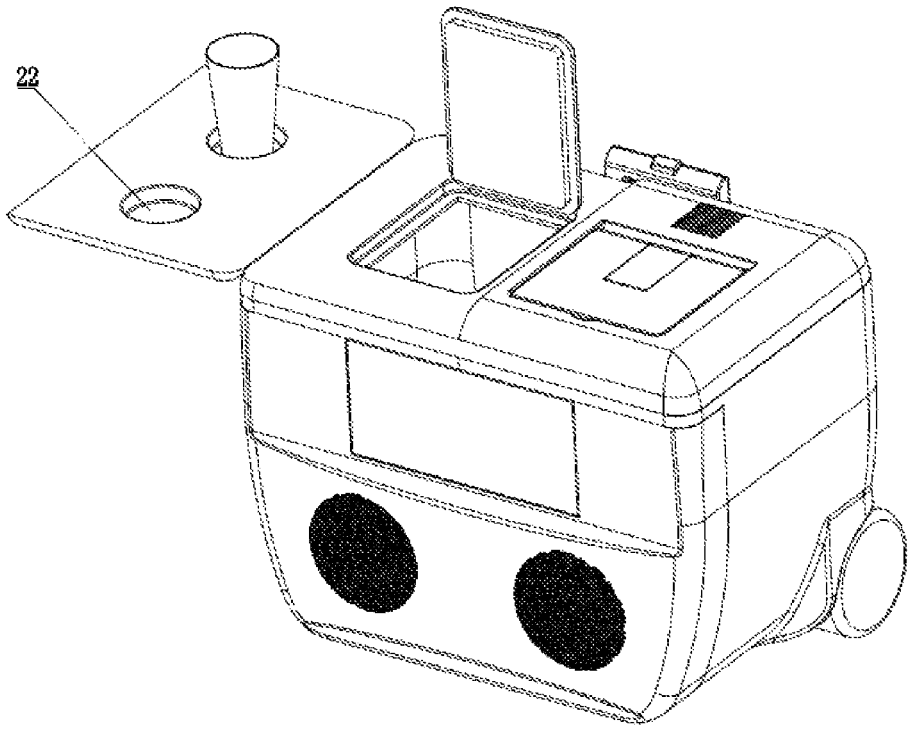
FIG. 14 is a structural schematic diagram of multifunctional portable sound equipment provided in embodiment 9.

The multifunctional portable sound equipment provided in the present embodiment has a general structure consistent with that of the embodiment 8, as shown in FIG. 14. However, in the multifunctional portable sound equipment provided in the present embodiment, a pair of limiting grooves 22 used for placing cups or bottles is arranged in the box cover panel 7 in the structure.

Embodiment 10

Figure 15:
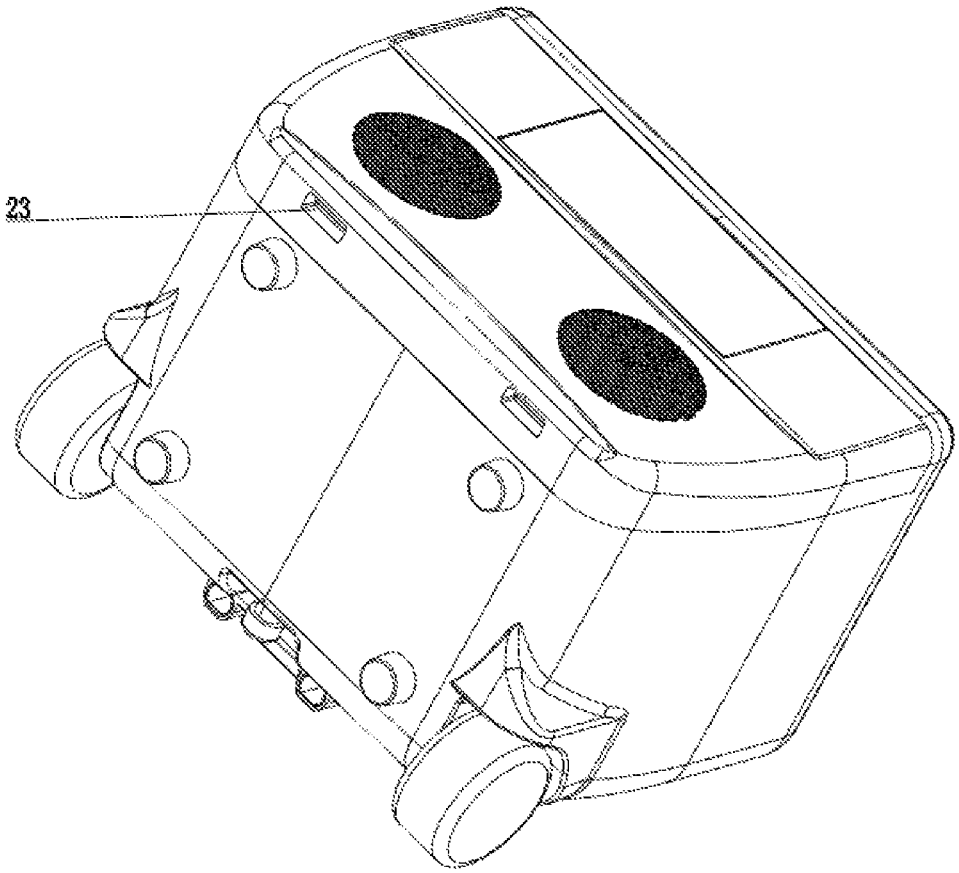
FIG. 15 is a structural schematic diagram of multifunctional portable sound equipment provided in embodiment 10.

The multifunctional portable sound equipment provided in the present embodiment has a general structure consistent with that of the embodiment 9, as shown in FIG. 15. However, in the multifunctional portable sound equipment provided in the present embodiment, a pair of hook holes 23 is arranged on the bottom surface of the box body 1 in the structure.

Embodiment 11

Figure 16:
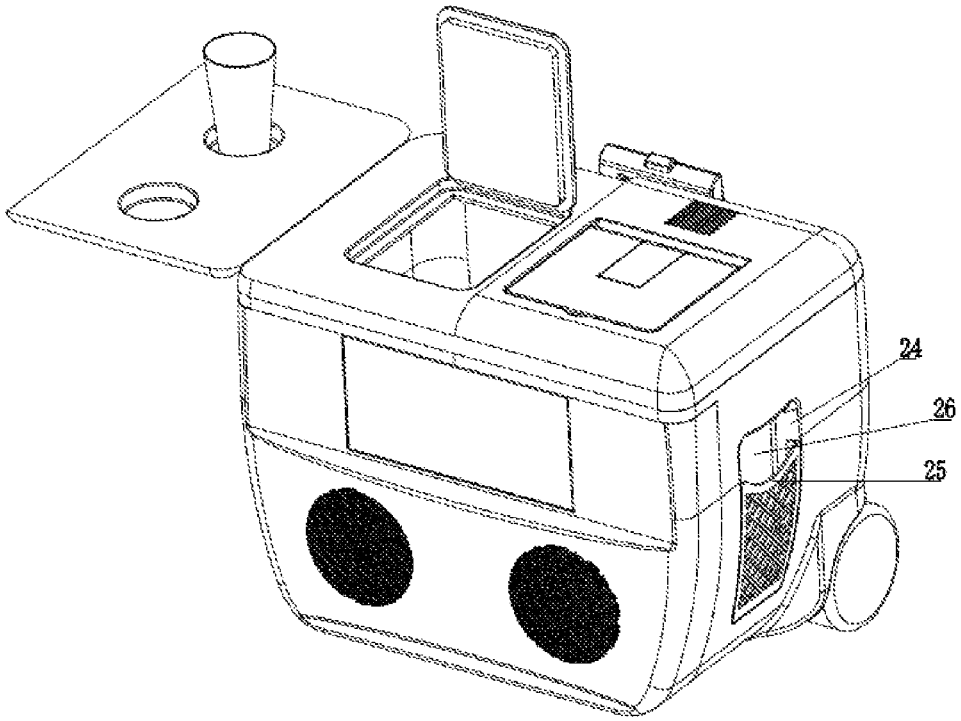
FIG. 16 is a structural schematic diagram of multifunctional portable sound equipment provided in embodiment 11.

The multifunctional portable sound equipment provided in the present embodiment has a general structure consistent with that of the embodiment 10, as shown in FIG. 16. However, in the multifunctional portable sound equipment provided in the present embodiment, surfaces on both sides of the box body 1 in the structure are provided with notches 24 facilitating hand grasp of a user when the user needs to move the portable sound equipment; the notches 24 on the surfaces on both sides mutually correspond to each other; a grid mesh 25 is arranged on an edge of each notch 24; and a gap 26 is arranged above the grid mesh 25.

Embodiment 12

Figure 17:
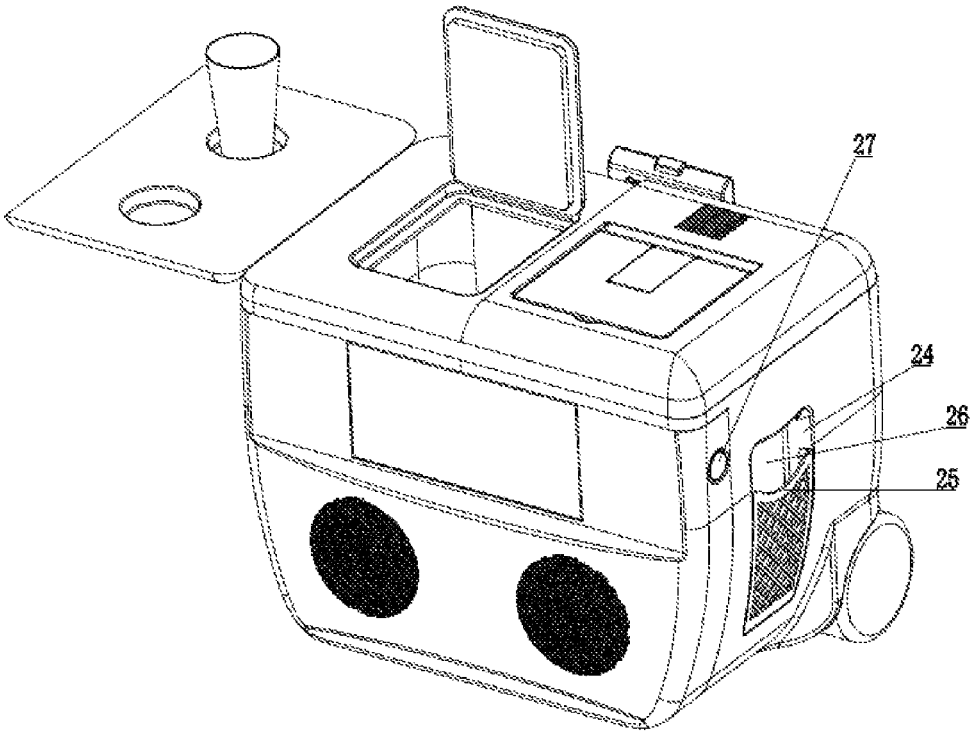
FIG. 17 is a structural schematic diagram of multifunctional portable sound equipment provided in embodiment 12.

The multifunctional portable sound equipment provided in the present embodiment has a general structure consistent with that of the embodiment 11, as shown in FIG. 17. However, in the multifunctional portable sound equipment provided in the present embodiment, a USB charging interface 27 is additionally arranged on a side surface of the box body 1 in the structure.

Embodiment 13

Figure 18:
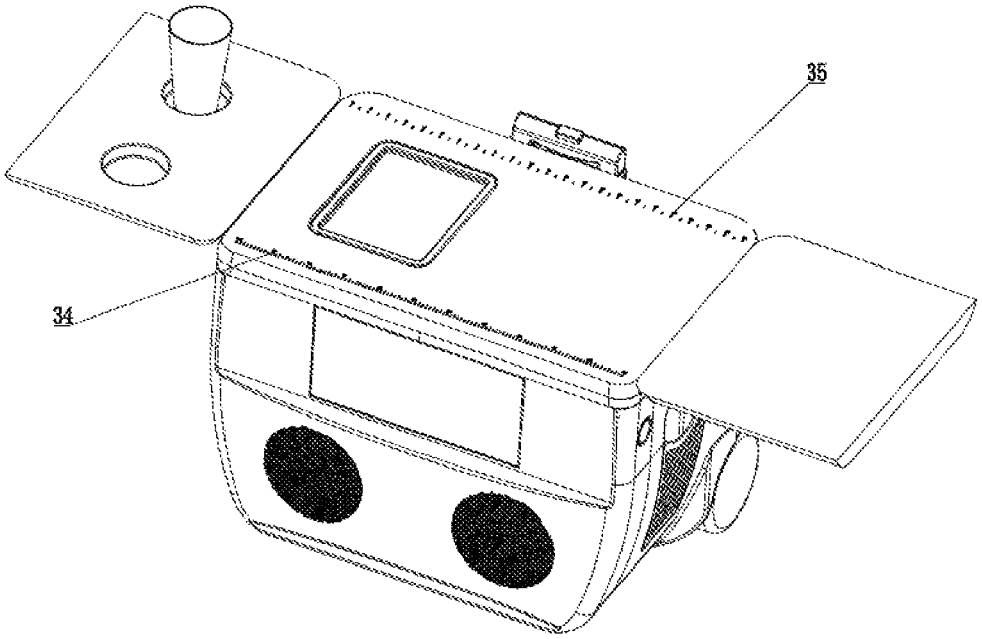
FIG. 18 is a structural schematic diagram of multifunctional portable sound equipment provided in embodiment 13.

The multifunctional portable sound equipment provided in the present embodiment has a general structure consistent with that of the embodiment 11, as shown in FIG. 18. However, in the multifunctional portable sound equipment provided in the present embodiment, an upper surface of the box cover substrate 6 in the structure is provided with a first scale 34 in centimeter and a second scale 35 in inch.

Embodiment 14

Figure 19:
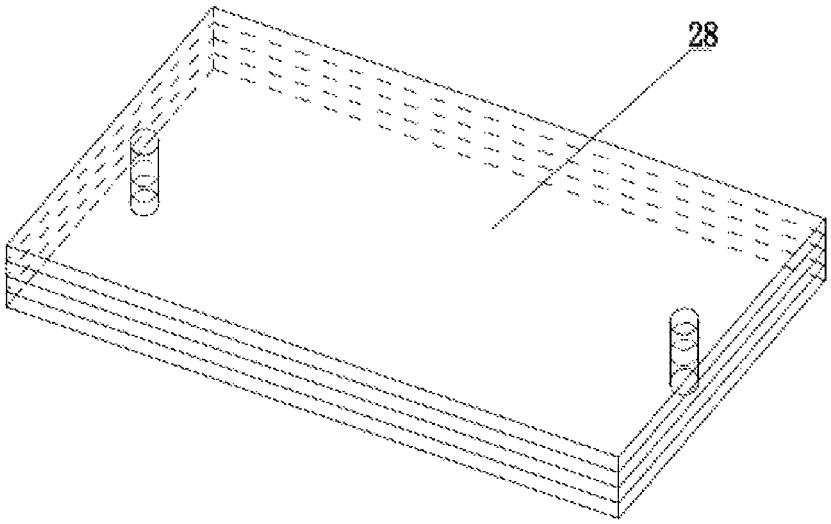
FIG. 19 is a structural schematic diagram 1 of a box cover in multifunctional portable sound equipment provided in embodiment 14.
Figure 20:
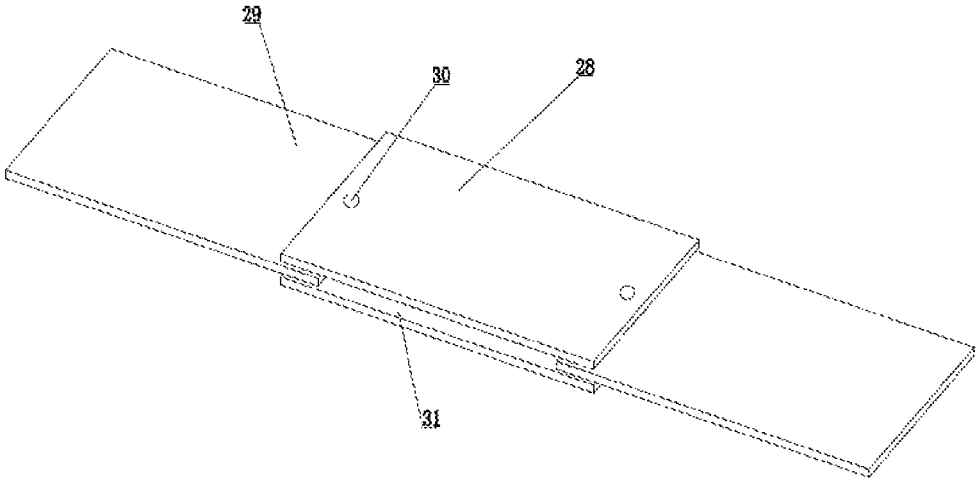
FIG. 20 is a structural schematic diagram 2 of a box cover in multifunctional portable sound equipment provided in embodiment 14.

The multifunctional portable sound equipment provided in the present embodiment has a general structure consistent with that of the embodiment 1, as shown in FIG. 19 and FIG. 20. However, in the multifunctional portable sound equipment provided in the present embodiment, the box cover 2 capable of being folded and unfolded in the structure has a specific structure as follows: the box cover 2 comprises two box cover main plates 28 and two box cover auxiliary plates 29; the two box cover main plates 28 are in a laminated structure; a clearance 31 is reserved between the two box cover main plates 28 which are fixed with a pair of connecting columns 30 jointly; the two box cover auxiliary plates 29 are movably hinged on one connecting column 30 respectively, and accommodated in the clearance 31 between the two box cover main plates 28; and when the box cover 2 needs to be used as the dining table, the user can turn out the box cover auxiliary plates 29 from the clearance 31 between the two box cover main plates 28.

I claim:

1. A multifunctional portable sound equipment, comprising an equipment body, wherein the equipment body is mainly composed of a box body (1) and a box cover (2) capable of being folded and unfolded; a heat preservation cavity (3) is arranged in the box body (1); a sealing cover of the box cover (2) is connected to an opening of the heat preservation cavity (3); the box cover (2) is mainly composed of a box cover substrate (6) and at least one box cover panel (7); a sealing cover of the box cover substrate (6) is connected to an opening of the heat preservation cavity (3); the box cover panel (7) is located above the box cover substrate (6); circumferential parts of the box cover panel (7) and the box cover substrate (6) are in a hinged structure; the box cover panel (7) is capable of turning around a hinging shaft at 180° relative to the box cover substrate (6); a turning supporting seat is additionally arranged on the box cover panel (7); the turning supporting seat comprises a seat plate (33) used for placing a tablet personal computer or a mobile phone, and a supporting plate (14) capable of being accommodated in the seat plate (33); one side end part of the supporting plate (14) is hinged on the seat plate (33); at least one stopping groove (15) is arranged in the box cover panel (7); the stopping grooves (15) are arranged in a direction of a turning track of the turning supporting seat according to a distance away from the turning supporting seat; and when the supporting plate (14) is in a used state, the other side end part is embedded into any one of the stopping grooves (15).

2. The multifunctional portable sound equipment according to claim 1, wherein an article taking opening (8) is arranged on the box cover substrate (6), and a covering cap (9) capable of sealing and covering the article taking opening (8) is hinged on an opening edge of the article taking opening (8).

3. The multifunctional portable sound equipment according to claim 2, wherein a middle separating plate (11) for separating the heat preservation cavity (3) into at least two independent chambers is arranged in the heat preservation cavity (3).

4. The multifunctional portable sound equipment according to claim 3, wherein a drainage passage (12) communicated with the heat preservation cavity (3) is also arranged on the box body (1); the drainage passage (12) is located below a back surface of the box body (1); and a sealing cover (13) is additionally arranged on a passage opening of the drainage passage (12).

5. The multifunctional portable sound equipment according to claim 1, wherein a power amplification operating window (16) is arranged on a front surface of the box body (1); at least one mobile phone accommodating opening (17) is arranged on an inner surface of the power amplification operating window (16); and a turning window covering cap (32) capable of sealing the power amplification operating window (16) is hinged on an outer edge of the power amplification operating window (16).

6. The multifunctional portable sound equipment according to claim 5, wherein a pull rod component (4) is fixed on the back surface of the box body (1); the pull rod component (4) is in a centering structure; at least one pair of rollers (5) is arranged on a bottom surface of the box body (1).

7. The multifunctional portable sound equipment according to claim 6, wherein a cutlery (18) is detachably fixed on an inner surface of the box cover substrate (6); a wine opener (19), a microphone (20) and a flashlight (21) are detachably fixed on a back surface of the box body (1); and at least one limiting groove (22) used for placing a cup or bottle is arranged in the box cover panel (7).

8. The multifunctional portable sound equipment according to claim 7, wherein at least one pair of hook holes (23) is arranged on the bottom surface of the box body (1); surfaces on both sides are provided with notches (24) facilitating hand grasp of a user when the user needs to move the portable sound equipment; the notches (24) on the surfaces on both sides mutually correspond to each other; a grid mesh (25) is arranged on an edge of each notch (24); a gap (26) is arranged above the grid mesh (25).

* * * * *